United States Patent [19]

Solymos

[11] 4,069,897

[45] Jan. 24, 1978

[54] ELEVATOR SYSTEM

[75] Inventor: Frederick Solymos, Glenridge, N.J.

[73] Assignee: Westinghouse Electric Corporation, Pittsburgh, Pa.

[21] Appl. No.: 717,963

[22] Filed: Aug. 26, 1976

[51] Int. Cl.[2] ..... B66B 5/28

[52] U.S. Cl. ..... 187/29 R; 187/67; 200/61.18

[58] Field of Search ..... 187/1, 29, 35, 67; 200/61.18, 61.93, 161

[56] References Cited

U.S. PATENT DOCUMENTS

| | | | |
|---|---|---|---|
| 1,614,675 | 1/1927 | Jones | 187/67 X |
| 1,654,650 | 1/1928 | Hymans | 187/35 X |
| 3,109,075 | 10/1963 | Ratcliff | 200/61.18 X |
| 3,798,631 | 3/1974 | Langford | 200/61.18 X |
| 3,814,876 | 6/1974 | Biafore | 200/161 X |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system including an elevator car mounted for vertical movement in a building hoistway, suitable control and drive means, and a buffer-switch combination located in the pit of the hoistway, the switch being electrically connected to the control means. An annular member is mounted about the buffer plunger so that it is free to rotate. A cable is connected between the annular member and the switch so that the switch is in one condition when the buffer plunger is restored and another condition when the plunger is retracted.

5 Claims, 2 Drawing Figures

ELEVATOR SYSTEM

BACKGROUND OF THE INVENTION

1. Field of the Invention

The invention relates in general to elevator systems, and more specifically, to elevator systems utilizing a buffer.

2. Description of the Prior Art

In elevator systems, it is required that a buffer be provided in the pit of the elevator hoistway to stop the elevator car in the event of overtravel. The buffer must accomplish this with a minimum of discomfort to the passengers and with a minimum of damage to the equipment. It is also common to provide a switch that is activated by movement of the buffer plunger and which acts to cut off power to the drive means whenever the plunger is in a retracted position. Once the elevator car has been moved away from the buffer, such as by a maintenance man using a switch override, the plunger is free to return to its restored position. If it fails to do so, the elevator should not be operated and further maintenance work is necessary. The switch operation has most recently been accomplished by a long cam mounted so that it moves in conjunction with the plunger in such a manner that when the plunger is in the retracted position, the cam contacts the switch sufficiently to operate it. When the elevator car moves away, the plunger normally returns to its restored position, allowing the switch to return to its original condition. In the event the plunger does not return to its restored position, the switch remains in its second condition and power is not restored to the drive, thus preventing a possibility of the elevator car later striking a retracted plunger. This type of construction is subject to alignment problems, however. The buffer plunger tends to exhibit rotational movement when struck by the elevator car, causing misalignment of the cam and the switch. Present methods used to preserve cam and switch alignment are often both costly and technically complicated.

SUMMARY OF THE INVENTION

This invention presents a new and improved means of insuring proper buffer switch operation in the event the associated buffer plunger should rotate when it is contacted by an elevator car. It employs a ring which is rotatably mounted about the plunger and held in place by a groove cut into the plunger below the plunger cap. Other means of mounting the ring are possible. A length of flexible connecting material, such as a steel cable, which is easily cut to the size desired for a particular buffer, has one end attached to the ring and the other end attached to the switch such that the switch is held in one condition with the plunger restored and allowed to move to another condition with the plunger retracted and the cable relaxed. When the plunger is returned to its restored position, the cable becomes taut and operates the switch to its first condition. In the event the plunger fails to restore itself, the switch remains in its second condition and power is not restored to the elevator drive. Because the ring is free to rotate about the plunger, the ring and cable will remain aligned with the switch should the plunger rotate.

DESCRIPTION OF THE PREFERRED EMBODIMENTS

Figure 1:
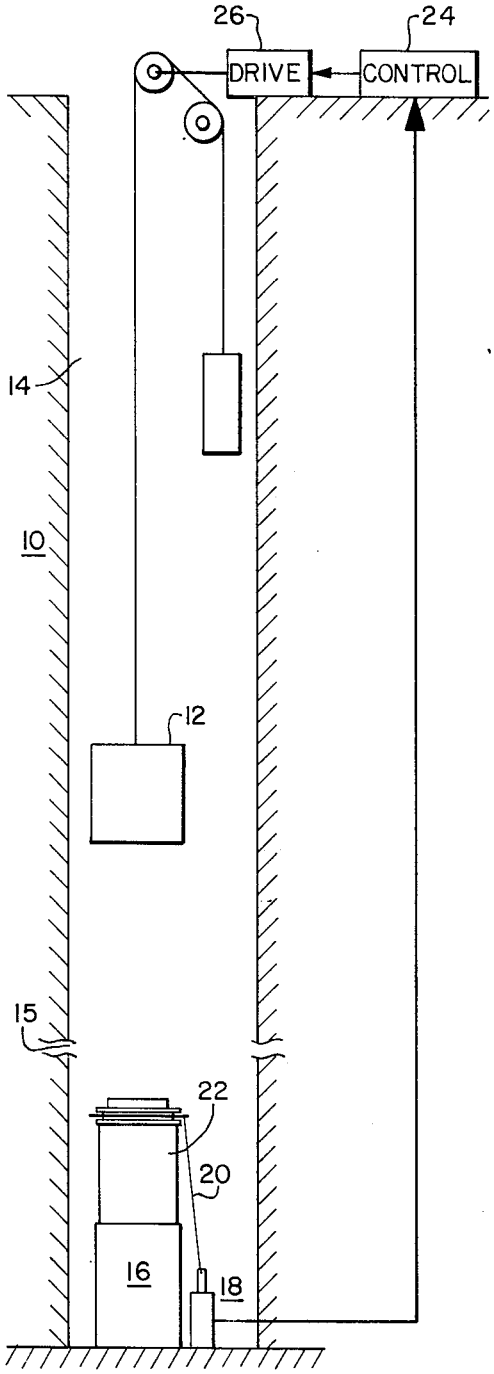
FIG. 1 is a diagrammatic view of an elevator system constructed according to the teachings of the invention.

With reference to FIG. 1, there is shown an elevator system 10, in which an elevator car 12 moves vertically in a hoistway 14. Below the lower terminal floor 15 of the hoistway, in an area commonly referred to as the pit of the hoistway, there is located a buffer 16, positioned under the elevator car 12.

Figure 2:
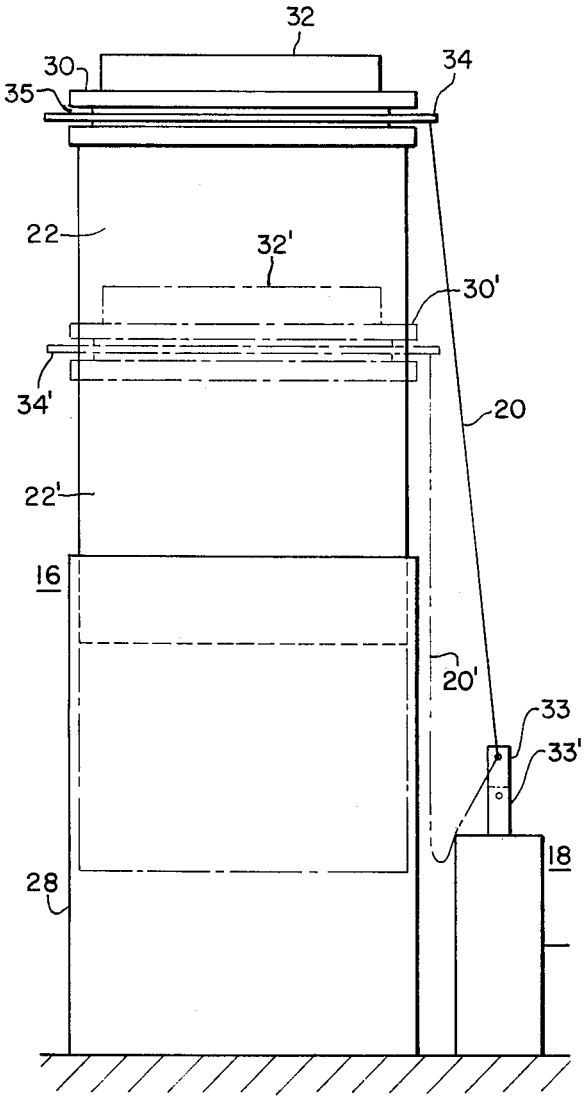
FIG. 2 is an elevational view of a buffer and switch assembly shown in FIG. 1. Both restored and retracted positions of the buffer are illustrated, with the retracted position being shown in phantom.

The buffer 16, which is illustrated in detail in FIG. 2, is a self-restoring type comprised of a cylinder 28, a plunger 22 having a circular cross-sectional configuration, and a plunger cap 30. An impact absorbing member 32, such as a disc shaped member formed of rubber or wood, is mounted on top of the plunger cap 30. An annular or ring shaped member 34 is mounted in a groove 35 disposed in the outer periphery of the plunger 22 below the plunger cap 30. The dimensions of the groove 35 and of the annular member 34 are selected such that the annular member 34 is free to rotate about the plunger 22. The buffer plunger 22 is operable between the restored and retracted positions, with the restracted position being effected when the elevator 12 is down on the buffer. While the buffer 16 shown in FIGS. 1 and 2 is of the fluid type, the invention is applicable to any buffer having similar characteristics and configuration as those described.

Mounted adjacent to buffer 16 is a switch 18 which includes an operating arm 33 having a biased and unbiased position (FIG. 2), and a biasing means (not shown). The switch 18 is operable between first and second conditions by means of the operating arm. The switch 18 is normally biased to its second condition, so that a force must be applied to the operating arm 33 for switch 18 to be in its first condition.

A connecting means 20, which is a flexible length of connecting material, such as a steel cable, is connected between the switch operating arm 33 and the annular member 34.

The elevator 10 also includes a control means 24 which is electrically connected to a drive means 26. The control means 24 is programmed to accept and interpret elevator call commands and to operate the drive means 26 to move the elevator car 12 to answer calls in a predetermined manner. The switch 18 is electrically connected to control means 24, with switch 18 acting to modify the operation of the elevator car 12 in the event switch 18 is in its second condition, such as by cutting power to the drive means 16.

The elevator system shown in FIG. 1 is of the traction type, but the invention described is not limited to any specific type of elevator design. It is equally applicable to any elevator system which utilizes a buffer having the configuration and characteristics previously described.

FIG. 2 is an elevational view of the buffer and switch assembly shown in FIG. 1, illustrating the buffer plunger 22 in both its restored and retracted positions, and operating arm 33 in its unbiased and biased positions. Corresponding components of the buffer 16 in its retracted position and of switch 18 in its second condition are designated as prime.

When the plunger 22 is in a restored position, the connecting means 20 is taut or under tension and the switch operating arm 33 is pulled to its unbiased position by action of the plunger 22 on the rotatable annular member 34, which is connected to one end of the connecting means 20. Switch 18 is then held in its first condition. When the elevator car 12 contacts the buffer, the plunger 22 is retracted into the cylinder 28. The connecting means 20' becomes flaccid and the switch 18 operates and enters its second condition. When the elevator car 12 is moved away from the buffer, plunger 22' must return to its restored position or control 24 determines switch 18 is still in its second condition. Rotation of the plunger 22 as it returns to its restored position does not cause alignment problems or otherwise adversely affect the next operation of the switch 18, due to the ability of the annular member 34 to maintain its alignment with the switch operating arm 33. Should the plunger 22 fail to return to its restored position when the car 12 is moved upwardly by maintenance personnel, absent some form of switch override, the operation of the elevator system is modified, such as by power being cut to the drive means 16, until the plunger 22' is returned to its restored position.

In summary, there has been disclosed a new and improved elevator system which through a buffer and switch combination affords protection against operating the system whenever the buffer is not in a restored position. In addition, through the use of a rotatable annular member mounted about the buffer plunger, possibility of a switch malfunction due to misalignment caused by plunger rotation has been eliminated.

I claim as my invention:

1. An elevator system comprising:

an elevator car mounted for vertical movement in the hoistway of the building;

drive means for moving said elevator car in said hoistway;

control means for operating said drive means;

a self-restoring buffer having a plunger, said buffer being disposed in said hoistway below said elevator car such that overtravel of said elevator car operates said plunger from a restored position to a retracted position;

a switch, operable between first and second conditions, disposed in said hoistway adjacent to said buffer, said switch being electrically connected to said control means;

self-aligning connecting means, operably connected between said switch and said plunger, such that said switch is operated between its first and second conditions when said plunger moves between its restored and retracted positions, whereby normal operation of said drive means is permitted only when said switch is in its first condition, corresponding to said plunger being in its restored position.

2. The elevator system of claim 1, wherein the self-aligning connecting means is connected between the switch and the plunger such that said switch is in its first condition only when said plunger is in its restored position.

3. The elevator system of claim 1, wherein the plunger of the buffer has a circular cross-sectional configuration.

4. The elevator system of claim 1, wherein the self-aligning connecting means includes a length of flexible connecting material and an annular member, said annular member being rotatably mounted about the plunger, with said flexible connecting material being connected between the switch and said annular member with a predetermined alignment, said rotatable annular member maintaining said predetermined alignment notwithstanding rotation of said plunger.

5. An elevator system comprising:

an elevator car mounted for vertical movement in the hoistway of a building;

drive means for moving said elevator car in said hoistway;

control means for operating said drive means;

a self-restoring buffer having a plunger with a circular cross-sectional configuration, said buffer being disposed in said hoistway below said elevator car such that overtravel of said elevator car operates said plunger from a restored position to a retracted position;

a switch operable between first and second conditions, said switch being disposed in said hoistway adjacent to said buffer, said switch being electrically connected to said control means;

self-aligning connecting means comprising a length of flexible connecting material and an annular member, said annular member being rotatably mounted about said plunger, with said flexible connecting material being connected between said switch and said annular member with a predetermined alignment, said annular member maintaining said predetermined alignment notwithstanding rotation of said plunger, whereby said switch is operated between first and second conditions when said plunger moves between its restored and retracted positions, said drive means operating normally only when said switch is in its first condition, corresponding to said plunger being in its restored position.

* * * * *